US010366652B2

(12) United States Patent
Hwang et al.

(10) Patent No.: US 10,366,652 B2
(45) Date of Patent: Jul. 30, 2019

(54) ORGANIC LIGHT-EMITTING DISPLAY APPARATUS

(71) Applicant: SAMSUNG DISPLAY CO., LTD., Yongin-si, Gyeonggi-do (KR)

(72) Inventors: Youngin Hwang, Yongin-si (KR); Haeyeon Lee, Yongin-si (KR); Inho Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 842 days.

(21) Appl. No.: 14/834,378

(22) Filed: Aug. 24, 2015

(65) Prior Publication Data

US 2016/0253964 A1 Sep. 1, 2016

(30) Foreign Application Priority Data

Feb. 26, 2015 (KR) ..... 10-2015-0027265

(51) Int. Cl.

| | |
|---|---|
| ***G09G 3/32*** | (2016.01) |
| ***G09G 3/3233*** | (2016.01) |
| *G09G 3/3266* | (2016.01) |
| *G09G 3/3291* | (2016.01) |

(52) U.S. Cl.

CPC ..... *G09G 3/3233* (2013.01); *G09G 3/3266* (2013.01); *G09G 3/3291* (2013.01); *G09G 2300/0819* (2013.01); *G09G 2300/0852* (2013.01); *G09G 2300/0861* (2013.01); *G09G 2300/0866* (2013.01); *G09G 2320/0233* (2013.01); *G09G 2320/043* (2013.01)

(58) Field of Classification Search

None

See application file for complete search history.

(56) References Cited

U.S. PATENT DOCUMENTS

| | | | | |
|---|---|---|---|---|
| 2005/0145891 | A1* | 7/2005 | Abe | G09G 3/3241 257/288 |
| 2006/0145964 | A1 | 7/2006 | Park et al. | |
| 2006/0151745 | A1* | 7/2006 | Kim | G09G 3/325 252/301.16 |
| 2011/0025671 | A1 | 2/2011 | Lee | |

FOREIGN PATENT DOCUMENTS

| | | | |
|---|---|---|---|
| KR | 10-2006-0080382 | A | 7/2006 |
| KR | 10-2011-0013693 | A | 2/2011 |
| KR | 10-2014-0067848 | A | 6/2014 |

* cited by examiner

*Primary Examiner* — Carl Adams

(74) *Attorney, Agent, or Firm* — Lewis Roca Rothgerber Christie LLP

(57) ABSTRACT

An organic light-emitting display apparatus includes: a first pixel including a first pixel circuit and a first light-emitting device to emit light in response to a first driving current received from the first pixel circuit; a second pixel including a second pixel circuit and a second light-emitting device to emit light in response to a second driving current received from the second pixel circuit; and a switch circuit connected between an anode electrode of the first light-emitting device and an anode electrode of the second light-emitting device.

19 Claims, 5 Drawing Sheets

ORGANIC LIGHT-EMITTING DISPLAY APPARATUS

CROSS-REFERENCE TO RELATED APPLICATION

This application claims priority to and the benefit of Korean Patent Application No. 10-2015-0027265, filed on Feb. 26, 2015, in the Korean Intellectual Property Office, the disclosure of which is incorporated herein in its entirety by reference.

BACKGROUND

1. Field

One or more exemplary embodiments relate to an organic light-emitting display apparatus.

2. Description of the Related Art

Along with the increase in the resolution of organic light-emitting display apparatuses, when light-emitting devices are miniaturized, a compensation point of a threshold voltage may be lowered. In this case, a threshold voltage difference between driving transistors may not be accurately compensated for, thereby causing a brightness difference between light-emitting devices, which may be observed by a viewer.

The above information disclosed in this Background section is only for enhancement of understanding of the background of the invention and therefore it may contain information that does not form the prior art that is already known to a person of ordinary skill in the art.

SUMMARY

One or more exemplary embodiments include an organic light-emitting display apparatus for which a problem that a threshold voltage is not accurately corrected due to the miniaturization of light-emitting devices along with an increase in resolution of organic light-emitting display apparatuses is improved.

Additional aspects will be set forth in part in the description which follows and, in part, will be apparent from the description, or may be learned by practice of the presented embodiments.

According to one or more exemplary embodiments, an organic light-emitting display apparatus includes: a first pixel including a first pixel circuit and a first light-emitting device configured to emit light in response to a first driving current received from the first pixel circuit; a second pixel including a second pixel circuit and a second light-emitting device configured to emit light in response to a second driving current received from the second pixel circuit; and a switch circuit connected between an anode electrode of the first light-emitting device and an anode electrode of the second light-emitting device.

The first pixel circuit may include a first transistor configured to be controlled by a first control signal, the second pixel circuit may include a second transistor configured to be controlled by a second control signal, and the switch circuit may be configured to be controlled by the first control signal and the second control signal.

The switch circuit may include: a first connection transistor configured to connect the anode electrode of the first light-emitting device to the anode electrode of the second light-emitting device in response to the first control signal; and a second connection transistor configured to be controlled by the second control signal and connected in parallel to the first connection transistor.

The first and second transistors and the first and second connection transistors may be P-type metal oxide semiconductor (MOS) transistors.

The first and second transistors and the first and second connection transistors may be N-type MOS transistors.

The organic light-emitting display apparatus may further include: a first control line configured to transfer the first control signal to the first pixel; a second control line configured to transfer the second control signal to the second pixel; a scan line configured to transfer a scan signal to the first pixel and the second pixel; a first data line configured to transfer a first data signal to the first pixel in synchronization with the scan signal; a second data line configured to transfer a second data signal to the second pixel in synchronization with the scan signal; and a power supply configured to apply a first power source voltage to the first and second pixel circuits, and to apply a second power source voltage to cathode electrodes of the first and second light-emitting devices.

The first pixel circuit may include: a first switching transistor configured to transfer the first data signal in response to the scan signal; a first data storage capacitor configured to store a voltage corresponding to the first data signal; and a first driving transistor configured to generate the first driving current based on the voltage stored in the first data storage capacitor; and the second pixel circuit may include: a second switching transistor configured to transfer the second data signal in response to the scan signal; a second data storage capacitor configured to store a voltage corresponding to the second data signal; and a second driving transistor configured to generate the second driving current based on the voltage stored in the second data storage capacitor.

The first pixel circuit may further include: a first threshold voltage storage capacitor configured to store a first threshold voltage of the first driving transistor; and the first transistor configured to diode-connect the first driving transistor in response to the first control signal; and the second pixel circuit may further include: a second threshold voltage storage capacitor configured to store a second threshold voltage of the second driving transistor; and the second transistor configured to diode-connect the second driving transistor in response to the second control signal.

Each of the first and second driving transistors may include a first electrode to which the first power source voltage is applied and a second electrode respectively connected to the anode electrode of the first and second light-emitting device, the first switching transistor may be configured to transfer the first data signal to a first node in response to the scan signal, the second switching transistor may be configured to transfer the second data signal to a second node in response to the scan signal, the first data storage capacitor may be connected between the first node and the first electrode of the first driving transistor, the second data storage capacitor may be connected between the second node and the first electrode of the second driving transistor, the first threshold voltage storage capacitor may be connected between the first node and a gate of the first driving transistor, the second threshold voltage storage capacitor may be connected between the second node and a gate of the second driving transistor, the first transistor may be configured to connect the gate of the first driving transistor and the second electrode of the first driving transistor in response to the first control signal, and the second transistor may be configured to connect the gate of the second driving transistor and the second electrode of the second driving transistor in response to the second control signal.

When the first driving transistor of the first pixel circuit is diode-connected by the first transistor turned on in response to the first control signal, the anode electrode of the first light-emitting device and the anode electrode of the second light-emitting device may be connected to each other via the first connection transistor turned on in response to the first control signal, and when the second driving transistor of the second pixel circuit is diode-connected by the second transistor turned on in response to the second control signal, the anode electrode of the first light-emitting device and the anode electrode of the second light-emitting device may be connected to each other via the second connection transistor turned on in response to the second control signal.

The organic light-emitting display apparatus may further include: a control line driver configured to output the first and second control signals through the first and second control lines, respectively; a scan driver configured to output the scan signal through the scan line; a data driver configured to output the first and second data signals through the first and second data lines, respectively; and a driving controller configured to control the control line driver, the scan driver, the data driver, and the power supply.

The driving controller may be configured to perform a method of driving the organic light-emitting display apparatus, the method including: first dropping voltages of the anode electrodes of the first and second light-emitting devices to voltages less than or equal to that of the cathode electrodes of the first and second light-emitting devices, respectively; first outputting the first control signal to store the first threshold voltage of the first driving transistor of the first pixel circuit in the first driving transistor storage capacitor of the first pixel circuit in a state where the anode electrode of the first light-emitting device and the anode electrode of the second light-emitting device are connected to each other; second dropping voltages of the anode electrodes of the first and second light-emitting devices to voltages less than or equal to that of the cathode electrodes of the first and second light-emitting devices, respectively; and second outputting the second control signal to store the second threshold voltage of the second driving transistor of the second pixel circuit in the second driving transistor storage capacitor of the second pixel circuit in a state where the anode electrode of the first light-emitting device and the anode electrode of the second light-emitting device are connected to each other.

The first dropping voltages, the first outputting the first control signal, the second dropping voltages, and the second outputting the second control signal may be sequentially performed within one frame of light-emitting.

Each of the first and second pixel circuits may further include the first or second transistor in order to transfer the first power source voltage to the first or second driving transistor in response to the first or second control signal.

The first or second transistor may be configured to transfer the first power source voltage to the first or second node in response to the first or second control signal, the first or second driving transistor may be connected between the first or second node and the anode electrode of the first or second light-emitting device and be configured to output the first or second driving current to the first or second light-emitting device according to a voltage level of a gate of the first or second driving transistor, the first or second switching transistor may be configured to transfer the first or second data signal to the gate of the first or second driving transistor in response to the scan signal, and the first or second data storage capacitor may be connected between the gate of the first or second driving transistor and the anode electrode of the first or second light-emitting device.

The organic light-emitting display apparatus may further include a third pixel including a third pixel circuit and a third light-emitting device configured to emit light in response to a third driving current received from the third pixel circuit, and the switch circuit may be connected between anode electrodes of the first, second, and third light-emitting devices.

According to one or more exemplary embodiments, a method of driving an organic light-emitting display apparatus including a first pixel including a first light-emitting device and a first driving transistor configured to output a first driving current to the first light-emitting device, and a second pixel including a second light-emitting device and a second driving transistor configured to output a second driving current to the second light-emitting device, includes: first dropping voltages of anode electrodes of the first and second light-emitting devices to voltages less than or equal to that of cathode electrodes of the first and second light-emitting devices, respectively; first storing a first threshold voltage of the first driving transistor in a state where the anode electrode of the first light-emitting device and the anode electrode of the second light-emitting device are connected to each other; second dropping voltages of the anode electrodes of the first and second light-emitting devices to voltages less than or equal to that of the cathode electrodes of the first and second light-emitting devices, respectively; and second storing a second threshold voltage of the second driving transistor in a state where the anode electrode of the first light-emitting device and the anode electrode of the second light-emitting device are connected to each other.

The first dropping voltages, the first storing the first threshold voltage, the second dropping voltages, and the second storing the second threshold voltage may be sequentially performed within one frame of light-emitting.

The method may further include: turning the first and second driving transistors on before the first dropping voltages; applying first and second data signals to the first and second pixels, respectively, after the second storing the second threshold voltage; and controlling the first and second light-emitting devices to concurrently emit lights having brightnesses corresponding to the first and second data signals, respectively.

The organic light-emitting display apparatus may further include a third pixel including a third light-emitting device and a third driving transistor configured to output a third driving current to the third light-emitting device, and the method may further include: third dropping voltages of anode electrodes of the first, second, and third light-emitting devices to voltages less than or equal to that of cathode electrodes of the first, second, and third light-emitting devices, respectively; and a third storing a third threshold voltage of the third driving transistor in a state where the anode electrodes of the first, second, and third light-emitting devices are connected to each other, wherein in the first and second dropping voltages, the voltages of the anode electrodes of the first, second, and third light-emitting devices may be respectively dropped to the voltages less than or equal to that of the cathode electrodes of the first, second, and third light-emitting devices.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
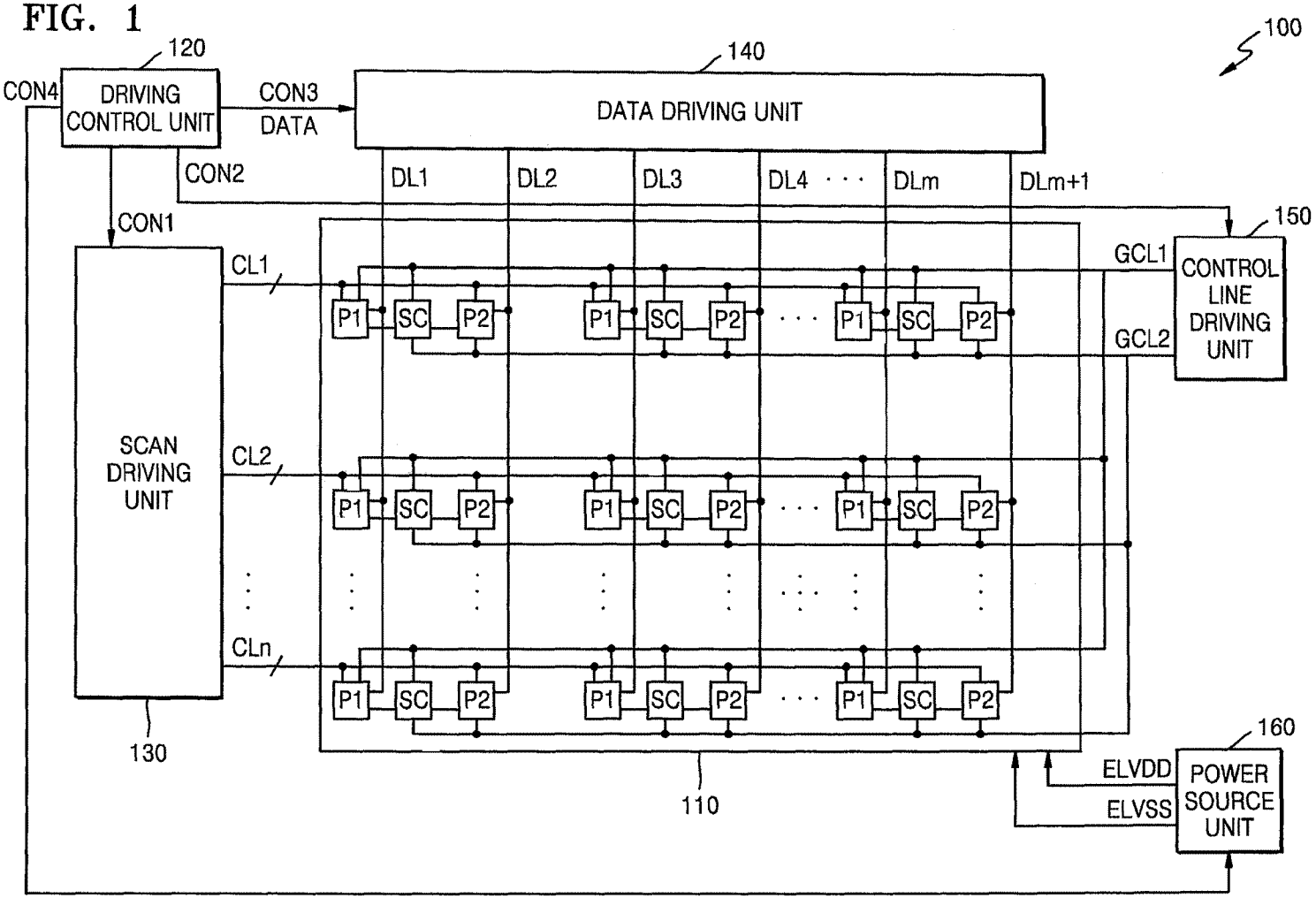
FIG. 1 illustrates a block diagram of an organic light-emitting display apparatus according to an exemplary embodiment of the inventive concept.

Reference will now be made in detail to exemplary embodiments, examples of which are illustrated in the accompanying drawings, wherein like reference numerals refer to like elements throughout. In this regard, the present inventive concept may be embodied in various different forms and should not be construed as being limited to the illustrated embodiments set forth herein. Rather, these embodiments are provided as examples so that this disclosure will be thorough and complete, and will fully convey the aspects and features of the present inventive concept to those skilled in the art. Accordingly, the exemplary embodiments are merely described below, by referring to the figures, to explain aspects and features of the inventive concept, and processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that although the terms "first", "second", etc. may be used herein to describe various components, these components should not be limited by these terms. These components are only used to distinguish one component from another. As used herein, the singular forms "a" and "an" are intended to include the plural forms as well, unless the context clearly indicates otherwise. It will be further understood that the terms "comprises," "comprising," "includes," and "including" used herein specify the presence of stated features or components, but do not preclude the presence or addition of one or more other features or components.

As used herein, the term "and/or" includes any and all combinations of one or more of the associated listed items. Expressions such as "at least one of," when preceding a list of elements, modify the entire list of elements and do not modify the individual elements of the list.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 illustrates a block diagram of an organic light-emitting display apparatus 100 according to an exemplary embodiment of the inventive concept.

Referring to FIG. 1, the organic light-emitting display apparatus 100 may include a display panel 110, a driving control unit (e.g., a driving controller) 120, a scan driving unit (e.g., a scan driver) 130, a data driving unit (e.g., a data driver) 140, a control line driving unit (e.g., a control line driver) 150, and a power source unit (or power supply) 160. The driving control unit 120, the scan driving unit 130, the data driving unit 140, and the control line driving unit 150 may be respectively formed in separate semiconductor chips, or may be integrated in one semiconductor chip. The organic light-emitting display apparatus 100 may be, for example, an electronic device capable of displaying images, such as a smartphone, a tablet PC, a laptop computer, a monitor, and/or a TV.

In the display panel 110, a plurality of (first and second) pixels P1 and P2 connected to a plurality of (first to nth) scan lines CL1 to CLn extending along a row direction (e.g., a horizontal direction in FIG. 1) and to a plurality of (first to (m+1)th) data lines DL1 to DLm+1 extending along a column direction (e.g., a vertical direction in FIG. 1) may be arranged.

The first and second pixels P1 and P2 adjacent to each other may be connected to each other through a switch circuit SC. The first pixels P1 may be connected to a first control line GCL1, and the second pixels P2 may be connected to a second control line GCL2.

Although FIG. 1 shows that one switch circuit SC is connected to one first pixel P1 and one second pixel P2, the present inventive concept is not limited thereto, and one switch circuit SC may be connected to three or more (e.g., four) pixels.

Pixels connected to one switch circuit SC are controlled through different control lines, respectively. That is, when four pixels are connected to one switch circuit SC, the four pixels may be controlled through four different control lines, respectively.

The number of control lines may be the same as the number of pixels connected to one switch circuit SC. For example, when one first pixel P1 and one second pixel P2 are connected to one switch circuit SC as in the display panel 110 shown in FIG. 1, two control lines (e.g., the first control line GCL1 and the second control line GCL2) may be used. In this case, the first control line GCL1 may be connected to the first pixel P1, and the second control line GCL2 may be connected to the second pixel P2. Hereinafter, examples in which two pixels (e.g., P1 and P2) are connected to one switch circuit SC will be described. However, it will be understood by those of ordinary skill in the art that the inventive concept could be applied to cases where three or more pixels are connected to one switch circuit SC.

Although FIG. 1 shows the first to nth scan lines CL1 to CLn as single signal lines for convenience, each of the first to nth scan lines CL1 to CLn may include a plurality of signal lines. For example, the first scan line CL1 may include at least one of signal lines for respectively transferring an initialization control signal, an emission control signal, and an anode initialization control signal.

A unit pixel may include a plurality of sub-pixels for respectively displaying a plurality of colors in order to display various colors. In the specification, a pixel (e.g., P1 or P2) mainly indicates one unit sub-pixel. However, the inventive concept is not limited thereto, and a pixel (e.g., P1 or P2) may indicate one unit pixel including a plurality of sub-pixels. That is, in the specification, even when it is described that one pixel (e.g., P1 or P2) exists, it may be analyzed that one sub-pixel exists, or it may be analyzed that a plurality of sub-pixels forming one unit pixel exists.

The driving control unit 120 may control the scan driving unit 130, the data driving unit 140, the control line driving unit 150, and the power source unit 160.

The driving control unit 120 may generate first, second, third, and fourth driving control signals CON1, CON2, CON3, and CON4 and digital image data DATA based on a horizontal synchronization signal and a vertical synchronization signal.

The driving control unit 120 may provide the first driving control signal CON1 to the scan driving unit 130, the second driving control signal CON2 to the control line driving unit 150, the third driving control signal CON3 and the digital image data DATA to the data driving unit 140, and the fourth driving control signal CON4 to the power source unit 160.

The scan driving unit 130 may provide control signals to pixels (e.g., P1 and P2) through the first to nth scan lines CL1 to CLn.

The data driving unit 140 may provide data signals to the pixels (e.g., P1 and P2) through the first to (m+1)th data lines DL1 to DLm+1.

The control line driving unit 150 may provide a control signal to the first pixels P1 through the first control line GCL1 and provide a control signal to the second pixels P2 through the second control line GCL2.

The power source unit 160 may apply a first power source voltage ELVDD and/or a second power source voltage ELVSS to the pixels (e.g., P1 and P2).

In the present specification, the term "corresponding" or "in correspondence with" may indicate an arrangement in a same column or row according to the context. For example, the wording "a first member is connected to a corresponding one of a plurality of second members" indicates that the first member is connected to a second member arranged in the same column or row as the first member.

Figure 2:
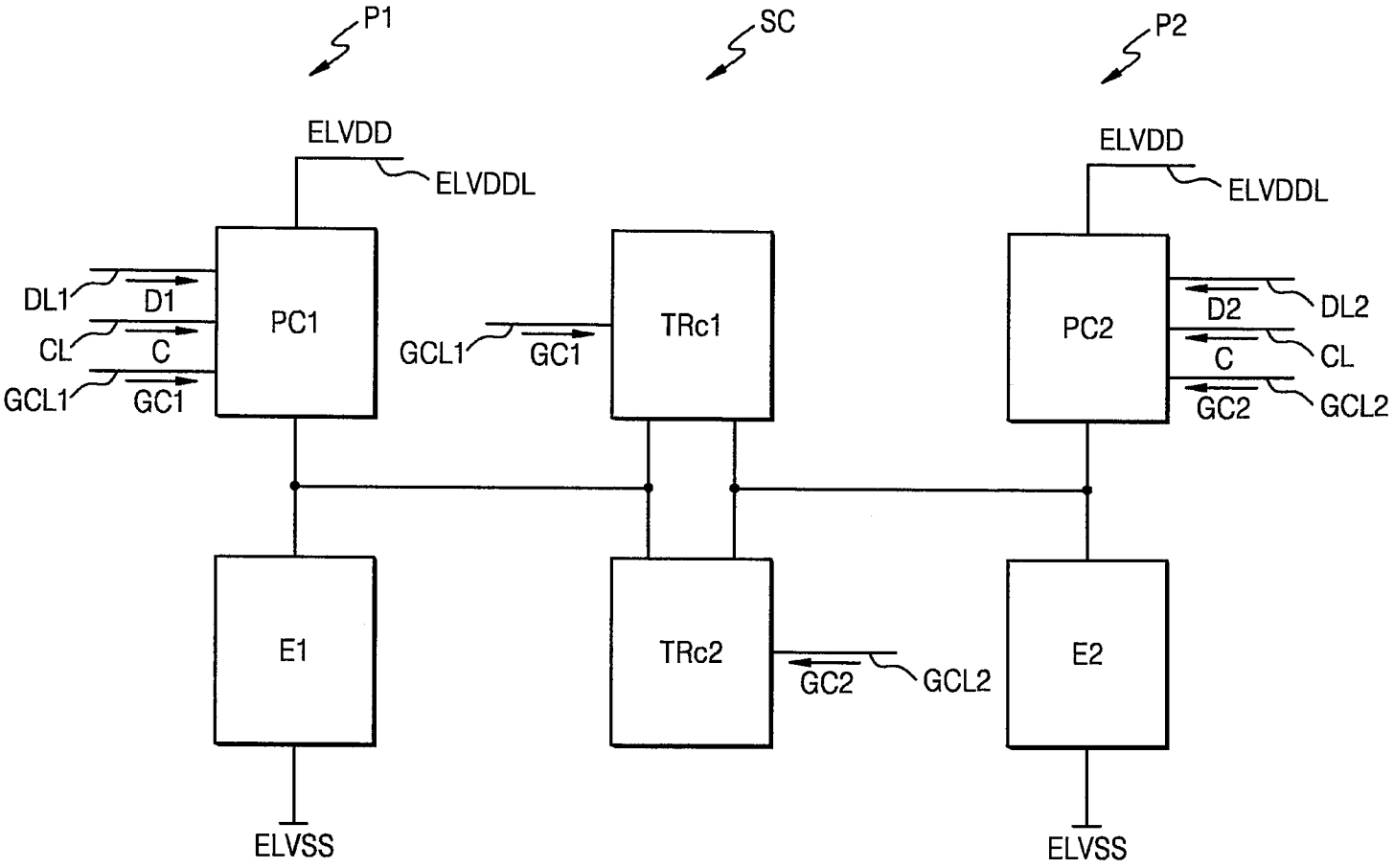
FIG. 2 illustrates a block diagram of pixels (P1 and P2) in the organic light-emitting display apparatus, according to an exemplary embodiment of the inventive concept.

FIG. 2 illustrates a block diagram of pixels (P1 and P2) in the organic light-emitting display apparatus 100, according to an exemplary embodiment of the inventive concept.

Referring to FIG. 2, each of the first and second pixels P1 and P2 includes a first or second pixel circuit PC1 or PC2, and a first or second light-emitting device E1 or E2 for emitting light by receiving a driving current from the first or second pixel circuit PC1 or PC2.

The first or second pixel P1 or P2, or each of the first and second pixels P1 and P2, may include one or more thin-film transistors (TFTs) and capacitors. The first or second pixel P1 or P2, or each of the first and second pixels P1 and P2, may emit light of a color of red, green, blue, or white. However, the present inventive concept is not limited thereto, and the first or second pixel P1 or P2, or both the first and second pixels P1 and P2, may emit light of a color other than red, green, blue, and white.

The first or second pixel circuit PC1 or PC2, or each of the first and second pixel circuits PC1 and PC2, is connected to a power source line ELVDDL, a first or second data line DL1 or DL2 arranged in the same column as the first or second pixel P1 or P2, a scan line CL arranged in the same row as the first or second pixel P1 or P2, and the first or second control line GCL1 or GCL2. The first or second pixel circuit PC1 or PC2, or each of the first and second pixel circuits PC1 and PC2, receives the first power source voltage ELVDD through the power source line ELVDDL, receives a data signal D1 or D2 through the first or second data line DL1 or DL2, and receives a scan signal C through the scan line CL. The first pixel circuit PC1 receives a first control signal GC1 through the first control line GCL1, and the second pixel circuit PC1 receives a second control signal GC2 through the second control line GCL2.

The first or second pixel circuit PC1 or PC2, or each of the first and second pixel circuits PC1 and PC2, includes a driving transistor for transferring a driving current corresponding to the data signal D1 or D2 to an output node of the first or second pixel circuit PC1 or PC2.

The first or second light-emitting device E1 or E2, or each of the first and second light-emitting devices E1 and E2, may include an organic light emitting diode (OLED) having an anode electrode connected to an output node of the first or second pixel circuit PC1 or PC2, and a cathode electrode to which the second power source voltage ELVSS is supplied.

A switch circuit SC is connected between the anode electrodes of the first and second light-emitting devices E1 and E2, which are respectively connected to the output nodes of the first and second pixel circuits PC1 and PC2.

The switch circuit SC may include one or more TFTs. The TFTs included in the switch circuit SC may have the same sizes and characteristics as those included in the first and/or second pixel circuit PC1 or PC2. According to another embodiment, the TFTs included in the switch circuit SC may have different sizes and characteristics from those of the TFTs included in the first and/or second pixel circuit PC1 or PC2.

The switch circuit SC is connected to the first or second control line GCL1 or GCL2, or both the first and second control lines GCL1 and GCL2, and receives the first or second control signal GC1 or GC2 through the first or second control line GCL1 or GCL2.

The switch circuit SC may include a first transistor TRc1 controlled by the first control signal, and a second transistor TRc2 controlled by the second control signal GC2.

Figure 3:
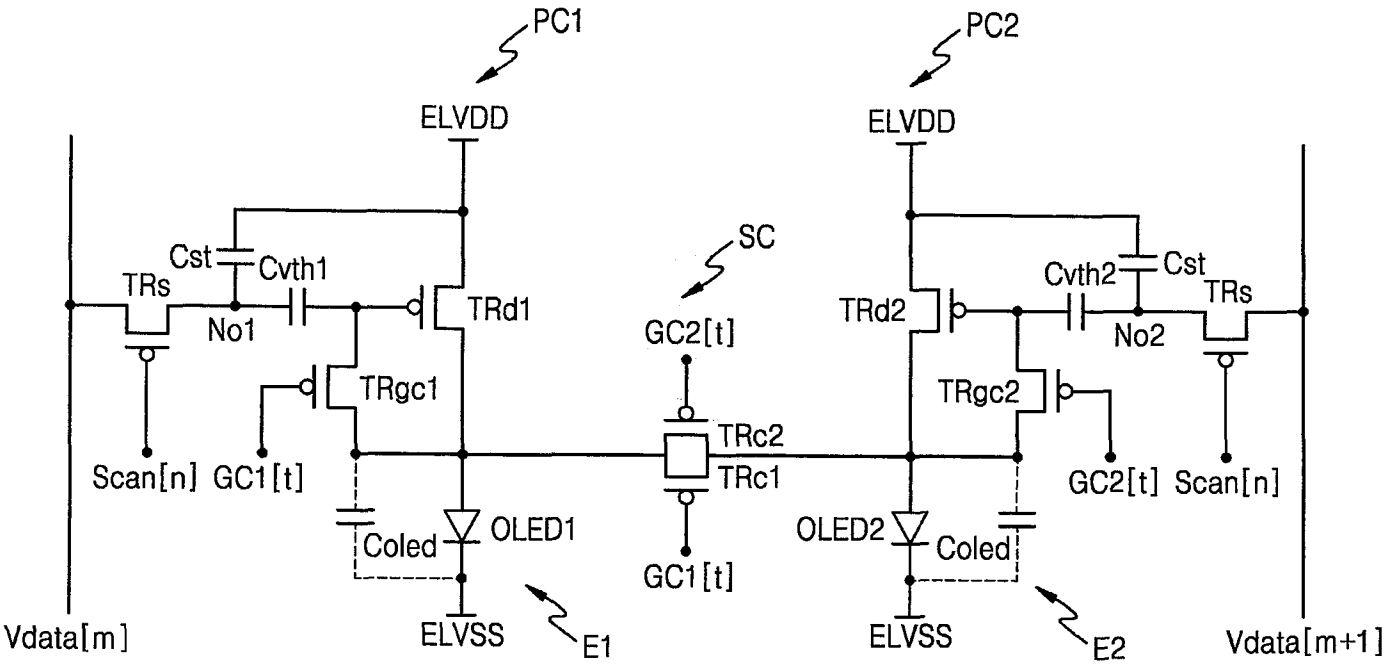
FIG. 3 illustrates a circuit diagram of pixels (P1 and P2) in the organic light-emitting display apparatus, according to an exemplary embodiment of the inventive concept.

FIG. 3 illustrates a circuit diagram of pixels (P1 and P2) in the organic light-emitting display apparatus 100, according to an exemplary embodiment of the inventive concept.

The pixels (P1 and P2) shown in FIG. 3 are the first pixel P1 located in an nth row and an mth column and the second pixel P2 located in an nth row and an (m+1)th column in correspondence with the first pixel P1.

The first and second pixels P1 and P2 are connected to a scan line corresponding to the nth row, and receive an nth scan signal Scan[n]. The first power source voltage ELVDD and the second power source voltage ELVSS are applied to the first and second pixels P1 and P2. The first pixel P1 is connected to a data line corresponding to the mth column, and receives an mth data signal Vdata[m] synchronized with the nth scan signal Scan[n]. The second pixel P2 is connected to a data line corresponding to the (m+1)th column, and receives an (m+1)th data signal Vdata[m+1] synchronized with the nth scan signal Scan[n]. The first pixel P1 receives the first control signal GC1 through the first control line GCL1, and the second pixel circuit PC1 receives the second control signal GC2 through the second control line GCL2.

Each of the first and second pixels P1 and P2 includes the first or second pixel circuit PC1 or PC2, and the first or second light-emitting device E1 or E2 for emitting light by receiving a driving current from the first or second pixel circuit PC1 or PC2.

The first or second pixel circuit PC1 or PC2, or each of the first and second pixel circuits PC1 and PC2, includes a switching transistor TRs. The switching transistor TRs transfers the mth or (m+1)th data signal Vdata[m] or Vdata[m+1] to a first or second node No1 or No2 in response to the nth scan signal Scan[n]. For example, when the switching transistor TRs is a P-type metal oxide semiconductor field effect transistor (MOSFET), the switching transistor TRs may be turned on in response to the nth scan signal Scan[n] of a low level.

The first or second pixel circuit PC1 or PC2, or each of the first and second pixel circuits PC1 and PC2, includes a data storage capacitor Cst. The data storage capacitor Cst stores a voltage corresponding to the mth or (m+1)th data signal Vdata[m] or Vdata[m+1].

The first or second pixel circuit PC1 or PC2, or each of the first and second pixel circuits PC1 and PC2, includes a first or second driving transistor TRd1 or TRd2 for generating the driving current based on the voltage stored in the data storage capacitor Cst. The first or second driving transistor TRd1 or TRd2, or each of the first and second driving transistors TRd1 and TRd2, includes a first electrode to which the first power source voltage ELVDD is applied, and a second electrode connected to the anode electrode of the first or second light-emitting devices E1 or E2.

The data storage capacitor Cst of each of the first and second pixel circuits PC1 or PC2 is connected to the first or second node No1 or No2 and the first electrode of the first or second driving transistor TRd1 or TRd2.

The first or second pixel circuit PC1 or PC2, or each of the first and second pixel circuits PC1 and PC2, includes a first or second threshold voltage storage capacitor Cvth1 or Cvth2 for storing a threshold voltage of the first or second driving transistor TRd1 or TRd2.

The first or second threshold voltage storage capacitor Cvth1 or Cvth2, or each of the first and second threshold voltage storage capacitors Cvth1 and Cvth2, stores a value including the threshold voltage of the first or second driving transistor TRd1 or TRd2.

The first or second threshold voltage storage capacitor Cvth1 or Cvth2, or each of the first and second threshold voltage storage capacitors Cvth1 and Cvth2, is connected between the first or second node No1 or No2 and a gate of the first or second driving transistor TRd1 or TRd2.

The first or second pixel circuit PC1 or PC2, or each of the first and second pixel circuits PC1 and PC2, includes a first or second transistor TRgc1 or TRgc2 for diode-connecting the first or second driving transistor TRd1 or TRd2 in response to the first or second control signal GC1 or GC2. That is, the first or second transistor TRgc1 or TRgc2 connects the gate of the first or second driving transistor TRd1 or TRd2 and the second electrode of the first or second driving transistor TRd1 or TRd2 in response to the first or second control signal GC1 or GC2.

The switch circuit SC is connected between the anode electrodes of the first and second light-emitting devices E1 and E2.

The switch circuit SC includes first and second connection transistors TRc1 and TRc2 for connecting the anode electrodes of the first and second light-emitting devices E1 and E2 to each other.

The first and second connection transistors TRc1 and TRc2 are connected in parallel to each other.

The first transistor TRgc1 and the first connection transistor TRc1 are controlled by the first control signal GC1, and the second transistor TRgc2 and the second connection transistor TRc2 are controlled by the second control signal GC2.

The first or second driving transistor TRd1 or TRd2, or both the first and second driving transistors TRd1 and TRd2, the switching transistors TRs, and the first or second connection transistor TRc1 or TRc2, or both the first and second connection transistors TRc1 and TRc2, may be P-type MOS transistors.

An operation of the first and second pixels P1 and P2 according to the circuit diagram of FIG. 3 will now be described.

The first and second pixels P1 and P2 according to the circuit diagram of FIG. 3 are driven by the driving control unit 120 shown in FIG. 1. An operation of the first and second pixels P1 and P2 will now be described with reference to FIG. 4.

The driving control unit 120 may control the second power source voltage ELVSS to be at a high level to perform an emission-off operation Off of turning emission of the first and second pixels P1 and P2 off. In the emission-off operation Off, the first and second driving transistors TRd1 and TRd2 may be turned on.

The driving control unit 120 may control the first power source voltage ELVDD to be at a low level to perform a first initialization operation Reset1 of dropping voltages of the anode electrodes of the first and second light-emitting devices E1 and E2 to voltages less than or equal to that of the cathode electrodes thereof through the turned-on first and second driving transistors TRd1 and TRd2, respectively.

The driving control unit 120 may perform a first threshold voltage correction operation Vth1 of storing the threshold voltage of the first driving transistor TRd1 in the first driving transistor storage capacitor Cvth1 in a state where the anode electrodes of the first and second light-emitting devices E1 and E2 are connected to each other, in response to the first control signal GC1. In the first threshold voltage correction operation Vth1, the threshold voltage of the first driving transistor TRd1 is stored in the first driving transistor storage capacitor Cvth1, and a detailed description thereof will be described below with reference to FIG. 4.

The driving control unit 120 may perform a second initialization operation Reset2 of controlling the first power source voltage ELVDD to be at the low level, turning the first and second driving transistors TRd1 and TRd2 on, and dropping the voltages of the anode electrodes of the first and second light-emitting devices E1 and E2 to voltages less than or equal to that of the cathode electrodes thereof through the turned-on first and second driving transistors TRd1 and TRd2, respectively, as described in the first initialization operation Reset1.

The driving control unit 120 may perform a second threshold voltage correction operation Vth2 of storing the threshold voltage of the second driving transistor TRd2 in the second driving transistor storage capacitor Cvth2 in a state where the anode electrodes of the first and second light-emitting devices E1 and E2 are connected to each other, in response to the second control signal GC2. In the second threshold voltage correction operation Vth2, the threshold voltage of the second driving transistor TRd2 is stored in the second driving transistor storage capacitor Cvth2, and a detailed description thereof will be described below with reference to FIG. 4

The driving control unit 120 may perform a scan operation Scan of applying the mth and (m+1)th data signals Vdata[m] and Vdata[m+1] to the first and second pixel circuits PC1 and PC2, respectively. In the scan operation Scan, the scan driving unit 130 sequentially drives the first to nth scan lines SL1 to SLn, and the data driving unit 140 provides data signals to all first and second pixels P1 and P2 in the display panel 110 through the first to mth data lines DL1 to DLm.

The driving control unit 120 may perform an emission operation Emission of controlling the first and second light-emitting devices E1 and E2 to concurrently (e.g., simultaneously) emit lights having brightnesses corresponding to the mth and (m+1)th data signals Vdata[m] and Vdata[m+1], respectively. All the first and second pixels P1 and P2 in the display panel 110 start emission when (e.g., as soon as) the second power source voltage ELVSS is changed to the low level.

The driving control unit 120 shown in FIG. 1 may sequentially perform the emission-off operation Off, the first initialization operation Reset1, the first threshold voltage correction operation Vth1, the second initialization operation Reset2, the second threshold voltage correction operation Vth2, the scan operation Scan, and the emission operation Emission within one frame.

Figure 4:
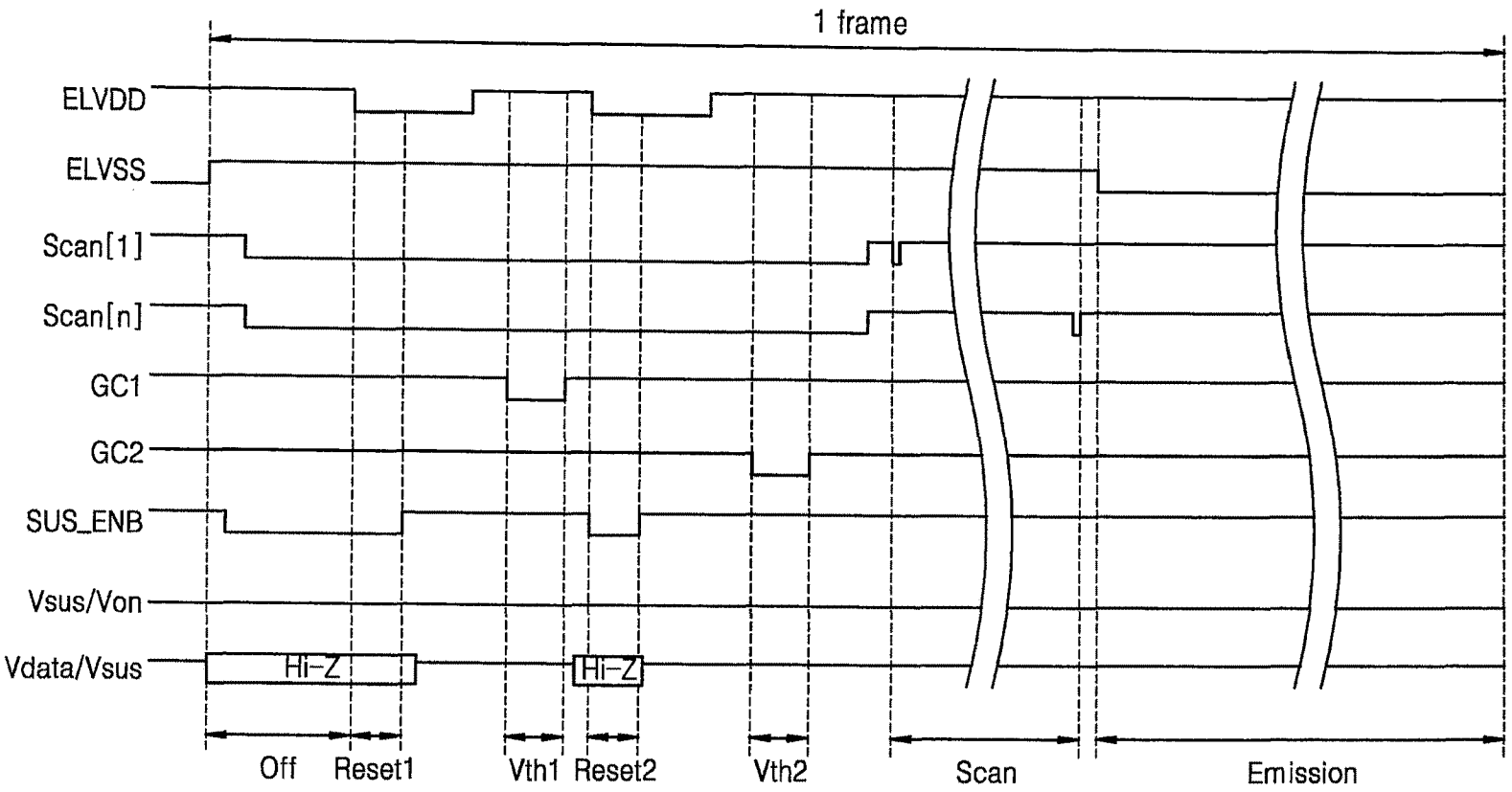
FIG. 4 illustrates a timing diagram of one frame section of the organic light-emitting display apparatus, according to an exemplary embodiment of the inventive concept.

FIG. 4 illustrates a timing diagram of one frame section of the organic light-emitting display apparatus 100, according to an exemplary embodiment of the inventive concept.

The operation of the first and second pixels P1 and P2 according to the embodiment of FIG. 3 will now be described in more detail with reference to FIG. 4.

The first and second pixels P1 and P2 perform the emission-off operation Off.

When the second power source voltage ELVSS is changed from the low level (e.g., ELVSS_L) to the high level (e.g., ELVSS_H), the emission-off operation Off starts, and all the first and second pixels P1 and P2 stop emission. At this time, the first power source voltage ELVDD is applied at the high level (e.g., ELVDD_H), the first to nth scan signals Scan[1] to Scan[n] are applied at the high level (e.g., Scan_H), and the first and second control signals GC1 and GC2 are applied at the high level (e.g., GC_H). Since the first to nth scan signals Scan[1] to Scan[n] are applied at the high level (e.g., Scan_H), the switching transistors TRs are turned off. The high level indicates a voltage level for turning a transistor off, and the low level indicates a voltage level for turning a transistor on. However, the present inventive concept is not limited thereto.

A voltage level of the high level ELVSS_H of the second power source voltage ELVSS may be the same or substantially the same as a voltage level of the high level ELVDD_H of the first power source voltage ELVDD so that emission of the first and second pixels P1 and P2 are off. For example, a difference between a voltage value of the high level ELVDD_H of the first power source voltage ELVDD and a voltage value of the high level ELVSS_H of the second power source voltage ELVSS may be less than threshold voltages of the first and second light-emitting devices E1 and E2. As a result, when the second power source voltage ELVSS is changed to the high level ELVSS_H, a driving current flowing through the first and second light-emitting devices E1 and E2 is reduced (e.g., sharply reduced).

The emission-off operation Off is an operation for black insertion or dimming after an emission operation, and a voltage between both electrodes of the first or second light-emitting device E1 or E2, or a voltage between respective electrodes of the first and second light-emitting devices E1 and E2, drops to an emission-off voltage, e.g., a voltage lower than the threshold voltage of the first or second light-emitting device E1 or E2, within a short time, e.g., 10 μs.

After the emission is off, the first to nth scan signals Scan[1] to Scan[n] are changed from the high level Scan_H to the low level (e.g., Scan_L), and a data switch signal SUS_ENB is changed from the high level to the low level. Accordingly, an initialization voltage Von is applied to a data line DL. When the data switch signal SUS_ENB is applied at the high level, the mth or (m+1)th data signal Vdata[m] or Vdata[m+1] or a reference voltage Vsus is applied to the data line DL. When the data switch signal SUS_ENB is applied at the low level, the initialization voltage Von is applied to the data line DL.

Since the first to nth scan signals Scan[1] to Scan[n] are applied at the low level Scan_L, the switching transistors TRs are turned on, and the initialization voltage Von is applied to the first and second nodes No1 and No2. The initialization voltage Von +, which is a voltage stored in the first or second threshold voltage storage capacitor Cvth1 or Cvth2 (hereinafter, referred to as threshold storage voltage Vcvth), is applied to the gates of the first and second driving transistors TRd1 and TRd2. The first and second driving transistors TRd1 and TRd2 are turned on, and a screen cloud effect due to a hysteresis phenomenon of the first and second driving transistors TRd1 and TRd2 may be offset.

The initialization voltage Von may be set so that the initialization voltage Von +, which is the threshold storage voltage Vcvth applied to the gates of the first and second driving transistors TRd1 and TRd2, turn the first and second driving transistors TRd1 and TRd2 on.

Next, after the emission off, the first and second pixels P1 and P2 perform an initialization operation and a threshold voltage correction. The initialization operation and the threshold voltage correction operation are repeated as many times as the number of pixels connected to the switch circuit SC. For example, as shown in FIG. 4, since two pixels (P1 and P2) are connected to each other through the switch circuit SC, each of the initialization operation and the threshold voltage correction operation is repeated two times.

In the first initialization operation Reset1, the first power source voltage ELVDD is changed from the high level ELVDD_H to the low level (e.g., ELVDD_L). The second power source voltage ELVSS is applied at the high level ELVSS_H, the first to nth scan signals Scan[1] to Scan[n] are applied at the low level Scan_L, the first and second control signals GC1 and GC2 are applied at the high level GC_H, and the initialization voltage Von is applied to the data line DL. By the first initialization operation Reset1, potentials of the anode electrodes of the first and second light-emitting devices E1 and E2 are initialized to about the low level ELVDD_L.

Since the first power source voltage ELVDD is changed from the high level ELVDD_H to the low level ELVDD_L in a state where the first and second driving transistors TRd1 and TRd2 are turned on, a voltage of the low level ELVDD_L (for example, a voltage obtained by adding the threshold voltage of the first or second driving transistor TRd1 or TRd2 to the voltage of the low level ELVDD_L) is applied to the anode electrode of the first or second light-emitting device E1 or E2. A voltage value of the low level ELVDD_L may be set to be less than a voltage value of the high level ELVDD_H. Since the second power source voltage ELVSS of the high level ELVSS_H is applied to the cathode electrode of the first or second light-emitting device E1 or E2, the potential of the anode electrode of the first or second light-emitting device E1 or E2 may be lower than that of the cathode electrode of the first or second light-emitting device E1 or E2.

In the first threshold voltage correction operation Vth1, the first power source voltage ELVDD is changed from the low level ELVDD_L to the high level ELVDD_H. The second power source voltage ELVSS is applied at the high level ELVSS_H, the first to nth scan signals Scan[1] to Scan[n] are applied at the low level Scan_L, the first control signal GC1 is changed from the high level GC_H to the low level (e.g., GC_L), and the second control signal GC2 is applied at the high level GC_H. Since the data switch signal SUS_ENB is changed from the low level to the high level, the reference voltage Vsus is applied to the data line DL.

Since the reference voltage Vsus is applied to the data line DL in a state where the switching transistors TRs are turned on, a potential of the first or second node No1 or No2, or both the first and second nodes No1 and No2, is changed to the reference voltage Vsus.

Since the first control signal GC1 is applied at the low level GC_L, the first transistor TRgc1 is turned on, thereby diode-connecting the first driving transistor TRd1 by electrically connecting the gate and the second electrode of the first driving transistor TRd1 to each other. Since the first power source voltage ELVDD of the high level ELVDD_H is applied in a state where the first driving transistor TRd1 is turned on, the potential of the anode electrode of the first light-emitting device E1 starts increasing from the low level ELVDD_L. The potential of the anode electrode of the first light-emitting device E1, e.g., a potential of the gate of the first driving transistor TRd1, reaches the high level ELVDD_H+the threshold voltage of the first driving transistor TRd1, and the first driving transistor TRd1 is turned off. Since a current flow through the first driving transistor TRd1 is blocked, the potential of the gate of the first driving transistor TRd1 becomes the high level ELVDD_H+the threshold voltage (hereinafter, referred to as a "first threshold voltage Vth_1") of the first driving transistor TRd1.

A voltage (e.g., Vcvth1) between ends of the first threshold voltage storage capacitor Cvth1 is a difference between the potential of the gate of the first driving transistor TRd1 and the potential of the first node No1, and becomes the high level ELVDD_H+the first threshold voltage Vth_1 of the first driving transistor TRd1−the reference voltage Vsus. The first threshold voltage storage capacitor Cvth1 may store the first threshold voltage Vth_1 of the first driving transistor TRd1.

Along with an increase in resolution of an organic light-emitting display apparatus, the first light-emitting device E1 is miniaturized, and a capacitance of a parasitic capacitor Coled of the first light-emitting device E1, which is a capacitance from the second electrode of the first driving transistor TRd1 to the first light-emitting device E1, may be reduced. Due to the reduced capacitance of the parasitic capacitor Coled, the potential of the anode electrode of the first light-emitting device E1 increases (e.g., impulsively increases) from the low level ELVDD_L to the high level ELVDD_H+the first threshold voltage Vth_1 of the first driving transistor TRd1 during the first threshold voltage correction operation Vth1, and a magnitude of a current flowing through the first driving transistor TRd1 is less (e.g., significantly less) than a magnitude of a current during actual driving of the first driving transistor TRd1. As a result, the first threshold voltage Vth_1 of the first driving transistor TRd1, which is lower than a threshold voltage Vth of the first driving transistor TRd1 during actual driving of the first driving transistor TRd1, may be stored in the first threshold voltage storage capacitor Cvth1. That is, a compensation point of the threshold voltage Vth of the first driving transistor TRd1 may be lowered.

When a compensation point of a threshold voltage is lowered, a threshold voltage difference between driving transistors may not be accurately compensated for, and thus, a brightness difference between light-emitting devices may occur, which may be observed by a viewer.

According to the present embodiment, in response to the first control signal GC1 of the low level GC_L, during the first threshold voltage correction operation Vth1, the first connection transistor TRc1 is turned on, and the anode electrode of the first light-emitting device E1 and the anode electrode of the second light-emitting device E2 are connected to each other. Accordingly, a capacitance from the second electrode of the first driving transistor TRd1 to the first and second light-emitting devices E1 and E2 increases to a sum of capacitances of parasitic capacitors Coled of the first and second light-emitting devices E1 and E2, e.g., 2×Coled. At the moment when the potential of the anode electrode of the first light-emitting device E1 increases from the low level ELVDD_L to the high level ELVDD_H+the first threshold voltage Vth_1 of the first driving transistor TRd1 during the first threshold voltage correction operation Vth1, a magnitude of a current flowing through the first driving transistor TRd1 also increases due to the increased capacitance 2×Coled of the parasitic capacitors Coled. The magnitude of the current flowing through the first driving transistor TRd1 may be set so as to be the same or substantially the same as a magnitude of a current during actual driving of the first driving transistor TRd1. Therefore, the first threshold voltage Vth_1 of the first driving transistor TRd1, which is the same or substantially the same as the threshold voltage Vth of the first driving transistor TRd1 during actual driving of the first driving transistor TRd1, may be stored in the first threshold voltage storage capacitor Cvth1. Accordingly, a threshold voltage difference between driving transistors may be accurately compensated for, and thus, a brightness difference between light-emitting devices may be reduced or removed, and a high-quality image may be observed by a viewer.

In the second initialization operation Reset2, the first power source voltage ELVDD is changed from the high level ELVDD_H to the low level ELVDD_L. The second power source voltage ELVSS is applied at the high level ELVSS_H, the first to nth scan signals Scan[1] to Scan[n] are applied at the low level Scan_L, the first and second control signals GC1 and GC2 are applied at the high level GC_H, and the initialization voltage Von is applied to the data line DL by the data switch signal SUS_ENB of the low level.

Since the initialization voltage Von is applied to the data line DL, the first and second driving transistors TRd1 and TRd2 are turned on, and since the first power source voltage ELVDD is changed from the high level ELVDD_H to the low level ELVDD_L, potentials of the second electrodes of the first and second driving transistors TRd1 and TRd2 reach the low level ELVDD_L+a threshold voltage value of the first or second driving transistor TRd1 or TRd2. The potentials of the anode electrodes of the first and second light-emitting devices E1 and E2 connected to the second electrodes of the first and second driving transistors TRd1 and TRd2 are lower than the potentials of the cathode electrodes of the first and second light-emitting devices E1 and E2, respectively.

After the first threshold voltage correction operation, the potentials of the anode electrodes of the first and second light-emitting devices E1 and E2 increase to the high level ELVDD_H+the first threshold voltage Vth_1 of the first driving transistor TRd1. By the second initialization operation Reset2, the potentials of the anode electrodes of the first and second light-emitting devices E1 and E2 are initialized to about the low level ELVDD_L.

In the second threshold voltage correction operation Vth2, the first power source voltage ELVDD is changed from the low level ELVDD_L to the high level ELVDD_H. The second power source voltage ELVSS is applied at the high level ELVSS_H, and the first to nth scan signals Scan[1] to Scan[n] are applied at the low level Scan_L. The second control signal GC2 is changed from the high level GC_H to the low level GC_L, and the first control signal GC1 is applied at the high level GC_H. The reference voltage Vsus is applied to the data line DL by the data switch signal SUS_ENB of the high level.

Since the reference voltage Vsus is applied to the data line DL in a state where the switching transistors TRs are turned on, the potential of the first or second node No1 or No2, or both the first and second nodes No1 and No2, is changed to the reference voltage Vsus.

Since the second control signal GC2 is applied at the low level GC_L, the second transistor TRgc2 is turned on, thereby diode-connecting the second driving transistor TRd2 by electrically connecting the gate and the second electrode of the second driving transistor TRd2 to each other.

Since the first power source voltage ELVDD of the high level ELVDD_H is applied in a state where the second driving transistor TRd2 is turned on, the potential of the anode electrode of the second light-emitting device E2 starts increasing from the low level ELVDD_L. The potential of the anode electrode of the second light-emitting device E2, e.g., a potential of the gate of the second driving transistor TRd2, reaches the high level ELVDD_H+the threshold voltage of the second driving transistor TRd2, and the second driving transistor TRd2 is turned off. Since a current flow through the second driving transistor TRd2 is blocked, the potential of the gate of the second driving transistor TRd2 becomes the high level ELVDD_H+the threshold voltage (hereinafter, referred to as "second threshold voltage Vth_2") of the second driving transistor TRd2.

A voltage (e.g., Vcvth2) between ends of the second threshold voltage storage capacitor Cvth2 is a difference between the potential of the gate of the second driving transistor TRd2 and the potential of the second node No2, and becomes the high level ELVDD_H+the second threshold voltage Vth_2 of the second driving transistor TRd2−the reference voltage Vsus.

The second threshold voltage storage capacitor Cvth2 may store the second threshold voltage Vth_2 of the second driving transistor TRd2.

In detail, a voltage value stored in the first or second threshold voltage storage capacitor Cvth1 or Cvth2 of the first or second pixel P1 or P2 through the first and second threshold voltage correction operations Vth1 and Vth2 may be Vcvth1=ELVDD_H+Vth_1−Vsus or Vcvth2=ELVDD_H+Vth_2−Vsus. Values of ELVDD_H and Vsus may be applied from the first power source line ELVDDL and the data line DL, respectively, and a value of Vth_1 or Vth_2 is derived from the first or second driving transistor TRd1 or TRd2, and thus, a meaningful term in Vcvth1=ELVDD_H+Vth_1−Vsus or Vcvth2=ELVDD_H+Vth_2−Vsus, for threshold voltage correction between the first and second pixels P1 and P2 may correspond to Vth_1 or Vth_2. That is, since the first or second threshold voltage storage capacitor Cvth1 or Cvth2 stores the value of the first or second threshold voltage Vth_1 or Vth_2 of the first or second driving transistor TRd1 or TRd2 for the threshold voltage correction, it may be considered that the first or second threshold voltage storage capacitor Cvth1 or Cvth2 substantially stores the threshold voltage of the first or second driving transistor TRd1 or TRd2.

Hereinafter, although only "threshold voltage Vth" is expressed, it is to be understood that the threshold voltage Vth indicates the first or second threshold voltage Vth_1 or Vth_2 to which a variation substantially existing between the first and second driving transistors TRd1 and TRd2 is reflected.

Along with an increase in resolution of an organic light-emitting display apparatus, the second light-emitting device E2 is miniaturized, and a capacitance of the parasitic capacitor Coled of the second light-emitting device E2, which is a capacitance from the second electrode of the second driving transistor TRd2 to the second light-emitting device E2, is reduced. Due to the reduced capacitance of the parasitic capacitor Coled, the potential of the anode electrode of the second light-emitting device E2 increases (e.g., impulsively increases) from the low level ELVDD_L to the high level ELVDD_H+the second threshold voltage Vth_2 of the second driving transistor TRd2 during the second threshold voltage correction operation Vth2, and a magnitude of a current flowing through the second driving transistor TRd2 is less (e.g., significantly less) than a magnitude of a current during actual driving of the second driving transistor TRd2. As a result, the second threshold voltage Vth_2 of the second driving transistor TRd2, which is lower than a threshold voltage Vth of the second driving transistor TRd2 during actual driving of the second driving transistor TRd2, may be stored in the second threshold voltage storage capacitor Cvth2. That is, a compensation point of the threshold voltage Vth of the second driving transistor TRd2 may be lowered.

When a compensation point of a threshold voltage is lowered, a threshold voltage difference between driving transistors may not be accurately compensated for, and thus, a brightness difference between light-emitting devices may occur, which may be observed by a viewer.

According to the present embodiment, in response to the second control signal GC2 of the low level GC_L, during the second threshold voltage correction operation Vth2, the second connection transistor TRc2 is turned on, and the anode electrode of the first light-emitting device E1 and the anode electrode of the second light-emitting device E2 are connected to each other. Accordingly, a capacitance from the second electrode of the second driving transistor TRd2 to the first and second light-emitting devices E1 and E2 increases to a sum of the capacitances of the parasitic capacitors Coled of the first and second light-emitting devices E1 and E2, e.g., 2×Coled. At the moment when the potential of the anode electrode of the second light-emitting device E2 increases from the low level ELVDD_L to the high level ELVDD_H+the second threshold voltage Vth_2 of the second driving transistor TRd2 during the second threshold voltage correction operation Vth2, a magnitude of a current flowing through the second driving transistor TRd2 also increases due to the increased capacitance 2×Coled of the parasitic capacitors Coled. The magnitude of the current flowing through the second driving transistor TRd2 may be set so as to be the same or substantially the same as a magnitude of a current during actual driving of the second driving transistor TRd2. Therefore, the second threshold voltage Vth_2 of the second driving transistor TRd2, which is the same or substantially the same as the threshold voltage Vth of the second driving transistor TRd2 during actual driving of the second driving transistor TRd2, may be stored in the second threshold voltage storage capacitor Cvth2. Accordingly, a threshold voltage difference between driving transistors may be accurately compensated for, and thus, a brightness difference between light-emitting devices may be removed, and a high-quality image may be observed by a viewer.

Next, after the initialization operation and the threshold voltage correction operation, the first and second pixels P1 and P2 perform the scan operation Scan.

In the scan operation Scan, for each pixel connected to each scan line CL, the first to nth scan signals Scan[1] to Scan[n] are sequentially applied at the low level Scan_L, and the mth or (m+1)th data signal Vdata[m] or Vdata[m+1] is provided through each data line DL by being synchronized with the first to nth scan signals Scan[1] to Scan[n]. In this case, the data switch signal SUS_ENB is at the high level. The first power source voltage ELVDD is applied at the high level ELVDD_H, the second power source voltage ELVSS is applied at the high level ELVSS_H, and the first and second control signals GC1 and GC2 are applied at the high level GC_H.

Since the nth scan signal Scan[n] is applied at the low level Scan_L, the switching transistor TRs is turned on, and the mth or (m+1)th data signal Vdata[m] or Vdata[m+1] having a voltage (e.g., a predetermined voltage) is applied to the first or second node No1 or No2 through the first and second electrodes of the switching transistor TRs.

In this case, a data voltage Vdata is applied in a range of a first voltage value to a second voltage value, wherein, for example, the first voltage value indicates white, and the second voltage value indicates black.

Since the mth or (m+1)th data signal Vdata[m] or Vdata [m+1] is applied, the potential of the first or second node No1 or No2 is changed from the reference voltage Vsus to the data voltage Vdata, and the potential of the gate of the first or second driving transistor TRd1 or TRd2 is the potential of the first or second node No1 or No2+the voltage (Vcvth1 or Vcvth2) between ends of the first or second threshold voltage storage capacitor Cvth1 or Cvth2, and is thus, the high level ELVDD_H+the threshold voltage Vth of the first or second driving transistor TRd1 or TRd2+the data voltage Vdata−the reference voltage Vsus.

The first power source voltage ELVDD is applied at the high level ELVDD_H, and the second power source voltage ELVSS is applied at the high level ELVSS_H, and thus, no driving current flows from the first power source line ELVDDL to the first and second light-emitting devices E1 and E2.

Next, after the scan operation Scan, the first and second pixels P1 and P2 perform the emission operation Emission.

In the emission operation Emission, light is emitted since a driving current corresponding to the data voltage Vdata stored in the first or second pixel P1 or P2 is provided to the first or second light-emitting device E1 or E2 included in the first or second pixel P1 or P2. In this case, the first power source voltage ELVDD is applied at the high level ELVDD_H, the second power source voltage ELVSS is changed from the high level ELVSS_H to the low level ELVSS_L, the nth scan signal Scan[n] is applied at the high level Scan_H, and the first and second control signals GC1 and GC2 are applied at the high level GC_H.

Since the nth scan signal Scan[n] is applied at the high level Scan_H, the switching transistor TRs that is a P-type MOS transistor is turned off.

Since the second power source voltage ELVSS is applied at the low level ELVSS_L, a current path from the first power source line ELVDDL to the cathode electrodes of the first and second light-emitting devices E1 and E2 is formed, and a driving current corresponding to a gate-source voltage Vgs of the first or second driving transistor TRd1 or TRd2, e.g., a difference between the potential of the gate of the first or second driving transistor TRd1 or TRd2 and the potential of the first electrode of the first or second driving transistor TRd1 or TRd2, is applied to the first and second light-emitting devices E1 and E2. Accordingly the first and second light-emitting devices E1 and E2 emit light of brightnesses corresponding to the applied driving current.

The current flowing through the first and second light-emitting devices E1 and E2 becomes $Ioled=\beta/2(Vgs-Vth)^2=\beta/2(Vdata-Vsus)^2$. According to one or more embodiments, the driving current flowing through the first and second light-emitting devices E1 and E2 may improve a problem occurring due to the difference between the first and second threshold voltages Vth1 and Vth2 of the first and second driving transistors TRd1 and TRd2.

One frame is implemented through the emission-off operation Off, the first initialization operation Reset1, the first threshold voltage correction operation Vth1, the second initialization operation Reset2, the second threshold voltage correction operation Vth2, the scan operation Scan, and the emission operation Emission, and the operations may be cycled (e.g., continuously cycled) to implement a next frame (e.g., subsequent frames). That is, after the emission operation Emission shown in FIG. 4, the emission-off operation Off starts again for the next frame.

Although not shown in FIG. 4, it will be understood by those of ordinary skill in the art that even when three or more pixels are connected to one switch circuit SC, the timing diagram of FIG. 4 may be applied by adding one or more additional initialization operations and threshold voltage correction operations. For example, when three pixels are connected to one switch circuit SC, each of the initialization operation and the threshold voltage correction operation is repeated three times, and accordingly, one frame may be implemented through the emission-off operation Off, the first initialization operation Reset1, the first threshold voltage correction operation Vth1, the second initialization operation Reset2, the second threshold voltage correction operation Vth2, a third initialization operation Reset3, a third threshold voltage correction operation Vth3, the scan operation Scan, and the emission operation Emission.

Figure 5:
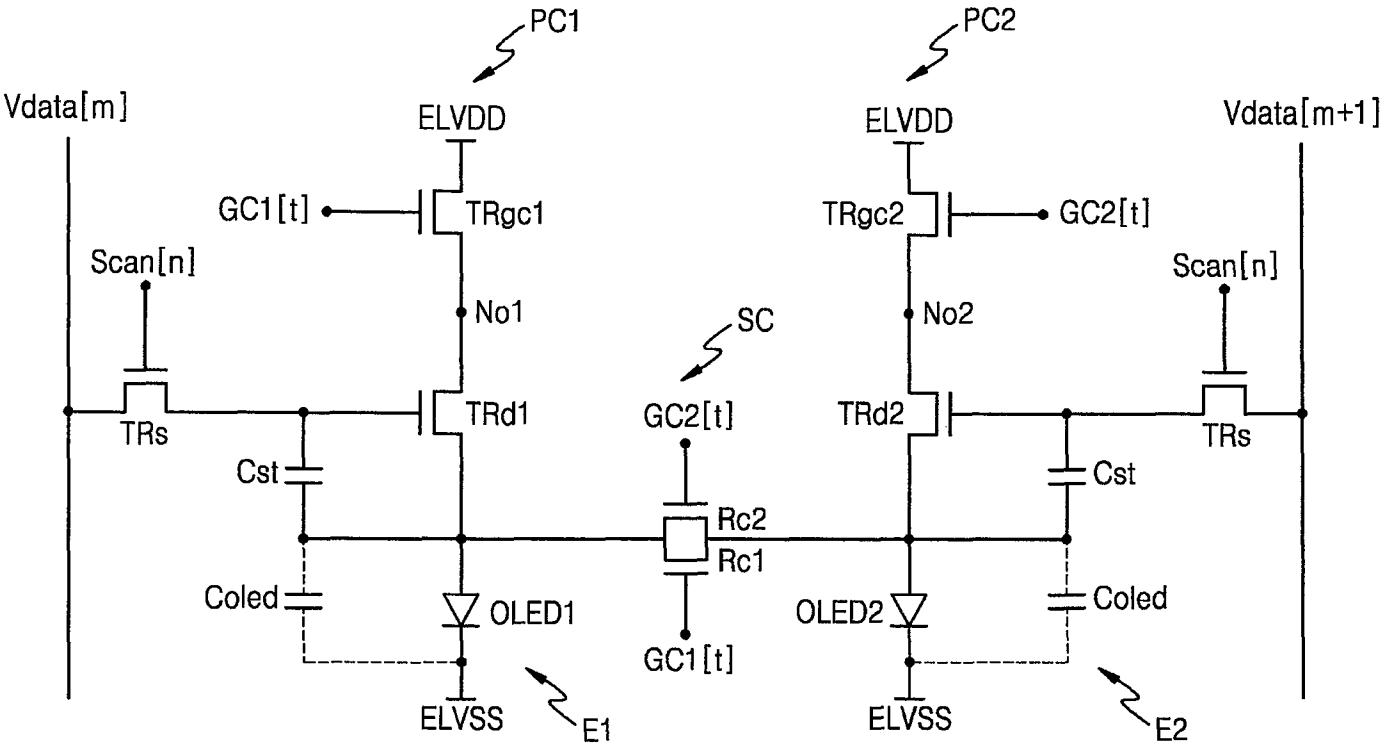
FIG. 5 illustrates a circuit diagram of pixels (P1 and P2) in the organic light-emitting display apparatus, according to another exemplary embodiment of the inventive concept.

FIG. 5 illustrates a circuit diagram of pixels (P1 and P2) in the organic light-emitting display apparatus 100, according to another exemplary embodiment of the inventive concept.

The pixels (P1 and P2) shown in FIG. 5 are the first pixel P1 located in the nth row and the mth column and the second pixel P2 located in the nth row and (m+1)th column in correspondence with the first pixel P1.

The first and second pixels P1 and P2 receive the first power source voltage ELVDD through the first power source line ELVDDL, receive the second power source voltage ELVSS from the outside, and are connected to a scan line corresponding to the nth row to receive the nth scan signal Scan[n]. The first pixel P1 is connected to a data line corresponding to the mth column, and receives the mth data signal Vdata[m] synchronized with the nth scan signal Scan[n]. The second pixel P2 is connected to a data line corresponding to the (m+1)th column, and receives the (m+1)th data signal Vdata[m+1] synchronized with the nth scan signal Scan[n]. The first pixel P1 receives the first control signal GC1 through the first control line GCL1, and the second pixel P2 receives the second control signal GC2 through the second control line GCL2.

Each of the first and second pixels P1 and P2 includes the first or second pixel circuit PC1 or PC2 and the first or second light-emitting device E1 or E2 for emitting light by receiving a driving current from the first or second pixel circuit PC1 or PC2.

The first or second pixel circuit PC1 or PC2, or each of the first and second pixel circuits PC1 and PC2, includes the first or second transistor TRgc1 or TRgc2 for transferring the first power source voltage ELVDD to the first or second node No1 or No2 in response to the first or second control signal GC1 or GC2.

The first or second pixel circuit PC1 or PC2, or each of the first and second pixel circuits PC1 and PC2, includes the first or second driving transistor TRd1 or TRd2 connected between the first or second node No1 or No2 and the anode electrode of the first or second light-emitting device E1 or E2 to output a driving current to the first or second light-emitting device E1 or E2 according to a voltage level of the gate of the first or second driving transistor TRd1 or TRd2.

The first or second pixel circuit PC1 or PC2, or each of the first and second pixel circuits PC1 and PC2, includes the switching transistor TRs for transferring the mth or (m+1)th data signal Vdata[m] or Vdata[m+1] to the gate of the first or second driving transistor TRd1 or TRd2 in response to the nth scan signal Scan[n].

The first or second pixel circuit PC1 or PC2, or each of the first and second pixel circuits PC1 and PC2, includes the data storage capacitor Cst connected between the gate of the first or second driving transistor TRd1 or TRd2 and the anode electrode of the first or second light-emitting device E1 or E2.

The data storage capacitor Cst stores a value including the data voltage Vdata.

The switch circuit SC is connected between the anode electrodes of the first and second light-emitting devices E1 and E2.

The switch circuit SC includes the first and second connection transistors Rc1 and Rc2 for connecting the anode electrodes of the first and second light-emitting devices E1 and E2 to each other in response to the first or second control signal GC1 or GC2.

The first and second connection transistors Rc1 and Rc2 are connected in parallel to each other.

The first transistor TRgc1 and the first connection transistor Rc1 are controlled by the first control signal GC1, and the second transistor TRgc2 and the second connection transistor Rc2 are controlled by the second control signal GC2.

Each of the first and second driving transistors TRd1 and TRd2, the switching transistors TRs, the first and second transistors TRgc1 and TRgc2, and the first and second connection transistors Rc1 and Rc2, according to an exemplary embodiment as shown in FIG. 5, may be an N-type MOS transistor.

As described above, according to the one or more of the above exemplary embodiments, a brightness difference between light-emitting devices, which may occur since a threshold voltage difference between driving transistors is not accurately compensated for, may be reduced by improving a problem that a threshold voltage is not accurately corrected due to the miniaturization of light-emitting devices along with an increase in resolution of the organic light-emitting display apparatus, thereby providing an organic light-emitting display apparatus having improved screen display quality.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein, without departing from the spirit and scope as defined by the following claims, and their equivalents.

What is claimed is:

1. An organic light-emitting display apparatus comprising:

a first pixel comprising a first pixel circuit and a first light-emitting device configured to emit light in response to a first driving current received from the first pixel circuit;

a second pixel comprising a second pixel circuit and a second light-emitting device configured to emit light in response to a second driving current received from the second pixel circuit; and a switch circuit connected between an anode electrode of the first light-emitting device and an anode electrode of the second light-emitting device, wherein the switch circuit comprises:

a first connection transistor configured to connect the anode electrode of the first light-emitting device to the anode electrode of the second light-emitting device in response to a first control signal; and a second connection transistor configured to be controlled by a second control signal and connected in parallel to the first connection transistor, wherein the first connection transistor including a first terminal directly connected to the anode electrode of the first light-emitting device and a second terminal directly connected to the anode electrode of the second light-emitting device, wherein the second connection transistor including a third terminal directly connected to the first terminal of the first connection transistor and a fourth terminal directly connected to the second terminal of the first connection transistor, and wherein the second control signal being different from the first control signal.

2. The organic light-emitting display apparatus of claim 1, wherein:

the first pixel circuit comprises a first transistor configured to be controlled by the first control signal;

the second pixel circuit comprises a second transistor configured to be controlled by the second control signal; and the switch circuit is configured to be controlled by the first control signal and the second control signal.

3. The organic light-emitting display apparatus of claim 1, wherein the first and second transistors and the first and second connection transistors are P-type metal oxide semiconductor (MOS) transistors.

4. The organic light-emitting display apparatus of claim 1, wherein the first and second transistors and the first and second connection transistors are N-type MOS transistors.

5. The organic light-emitting display apparatus of claim 1, further comprising:

a first control line configured to transfer the first control signal to the first pixel;

a second control line configured to transfer the second control signal to the second pixel;

a scan line configured to transfer a scan signal to the first pixel and the second pixel;

a first data line configured to transfer a first data signal to the first pixel in synchronization with the scan signal;

a second data line configured to transfer a second data signal to the second pixel in synchronization with the scan signal; and a power supply configured to apply a first power source voltage to the first and second pixel circuits, and to apply a second power source voltage to cathode electrodes of the first and second light-emitting devices.

6. The organic light-emitting display apparatus of claim 5, wherein:

the first pixel circuit comprises:

a first switching transistor configured to transfer the first data signal in response to the scan signal;

a first data storage capacitor configured to store a voltage corresponding to the first data signal; and a first driving transistor configured to generate the first driving current based on the voltage stored in the first data storage capacitor; and the second pixel circuit comprises:

a second switching transistor configured to transfer the second data signal in response to the scan signal;

a second data storage capacitor configured to store a voltage corresponding to the second data signal; and a second driving transistor configured to generate the second driving current based on the voltage stored in the second data storage capacitor.

7. The organic light-emitting display apparatus of claim 6, wherein:

the first pixel circuit further comprises:

a first threshold voltage storage capacitor configured to store a first threshold voltage of the first driving transistor; and the first transistor configured to diode-connect the first driving transistor in response to the first control signal; and the second pixel circuit further comprises:

a second threshold voltage storage capacitor configured to store a second threshold voltage of the second driving transistor; and the second transistor configured to diode-connect the second driving transistor in response to the second control signal.

8. The organic light-emitting display apparatus of claim 7, wherein:

each of the first and second driving transistors comprises a first electrode to which the first power source voltage is applied and a second electrode respectively connected to the anode electrode of the first and second light-emitting device;

the first switching transistor is configured to transfer the first data signal to a first node in response to the scan signal;

the second switching transistor is configured to transfer the second data signal to a second node in response to the scan signal;

the first data storage capacitor is connected between the first node and the first electrode of the first driving transistor;

the second data storage capacitor is connected between the second node and the first electrode of the second driving transistor;

the first threshold voltage storage capacitor is connected between the first node and a gate of the first driving transistor;

the second threshold voltage storage capacitor is connected between the second node and a gate of the second driving transistor;

the first transistor is configured to connect the gate of the first driving transistor and the second electrode of the first driving transistor in response to the first control signal; and the second transistor is configured to connect the gate of the second driving transistor and the second electrode of the second driving transistor in response to the second control signal.

9. The organic light-emitting display apparatus of claim 7, wherein:

when the first driving transistor of the first pixel circuit is diode-connected by the first transistor being turned on in response to the first control signal, the anode electrode of the first light-emitting device and the anode electrode of the second light-emitting device are connected to each other via the first connection transistor turned on in response to the first control signal; and when the second driving transistor of the second pixel circuit is diode-connected by the second transistor being turned on in response to the second control signal, the anode electrode of the first light-emitting device and the anode electrode of the second light-emitting device are connected to each other via the second connection transistor turned on in response to the second control signal.

10. The organic light-emitting display apparatus of claim 7, further comprising:

a control line driver configured to output the first and second control signals through the first and second control lines, respectively;

a scan driver configured to output the scan signal through the scan line;

a data driver configured to output the first and second data signals through the first and second data lines, respectively; and a driving controller configured to control the control line driver, the scan driver, the data driver, and the power supply.

11. The organic light-emitting display apparatus of claim 10, wherein the driving controller is configured to perform a method of driving the organic light-emitting display apparatus, the method comprising:

first dropping voltages of the anode electrodes of the first and second light-emitting devices to voltages less than or equal to that of the cathode electrodes of the first and second light-emitting devices, respectively;

first outputting the first control signal to store the first threshold voltage of the first driving transistor of the first pixel circuit in the first threshold voltage storage capacitor of the first pixel circuit in a state where the anode electrode of the first light-emitting device and the anode electrode of the second light-emitting device are connected to each other;

second dropping voltages of the anode electrodes of the first and second light-emitting devices to voltages less than or equal to that of the cathode electrodes of the first and second light-emitting devices, respectively; and second outputting the second control signal to store the second threshold voltage of the second threshold voltage of the second pixel circuit in the second driving transistor storage capacitor of the second pixel circuit in a state where the anode electrode of the first light-emitting device and the anode electrode of the second light-emitting device are connected to each other.

12. The organic light-emitting display apparatus of claim 11, wherein the first dropping voltages, the first outputting the first control signal, the second dropping voltages, and the second outputting the second control signal are sequentially performed within one frame of light-emitting.

13. The organic light-emitting display apparatus of claim 6, wherein each of the first and second pixel circuits further comprises the first or second transistor in order to transfer the first power source voltage to the first or second driving transistor in response to the first or second control signal.

14. The organic light-emitting display apparatus of claim 13, wherein the first or second transistor is configured to transfer the first power source voltage to the first or second node in response to the first or second control signal, the first or second driving transistor is connected between the first or second node and the anode electrode of the first or second light-emitting device and is configured to output the first or second driving current to the first or second light-emitting device according to a voltage level of a gate of the first or second driving transistor, the first or second switching transistor is configured to transfer the first or second data signal to the gate of the first or second driving transistor in response to the scan signal, and the first or second data storage capacitor is connected between the gate of the first or second driving transistor and the anode electrode of the first or second light-emitting device.

15. The organic light-emitting display apparatus of claim 1, further comprising a third pixel comprising a third pixel circuit and a third light-emitting device configured to emit light in response to a third driving current received from the third pixel circuit, wherein the switch circuit is connected between anode electrodes of the first, second, and third light-emitting devices.

16. A method of driving an organic light-emitting display apparatus comprising a first pixel comprising a first light-emitting device and a first driving transistor configured to output a first driving current to the first light-emitting device, and a second pixel comprising a second light-emitting device and a second driving transistor configured to output a second driving current to the second light-emitting device, the method comprising:

first dropping voltages of anode electrodes of the first and second light-emitting devices to voltages less than or equal to that of cathode electrodes of the first and second light-emitting devices, respectively;

first storing a first threshold voltage of the first driving transistor in a state where the anode electrode of the first light-emitting device and the anode electrode of the second light-emitting device are connected to each other;

second dropping voltages of the anode electrodes of the first and second light-emitting devices to voltages less than or equal to that of the cathode electrodes of the first and second light-emitting devices, respectively; and second storing a second threshold voltage of the second driving transistor in a state where the anode electrode of the first light-emitting device and the anode electrode of the second light-emitting device are connected to each other.

17. The method of claim 16, wherein the first dropping voltages, the first storing the first threshold voltage, the second dropping voltages, and the second storing the second threshold voltage are sequentially performed within one frame of light-emitting.

18. The method of claim 16, further comprising:

turning the first and second driving transistors on, before the first dropping voltages;

applying first and second data signals to the first and second pixels, respectively, after the second storing the second threshold voltage; and controlling the first and second light-emitting devices to concurrently emit lights having brightnesses corresponding to the first and second data signals, respectively.

19. The method of claim 16, wherein the organic light-emitting display apparatus further comprises a third pixel comprising a third light-emitting device and a third driving transistor configured to output a third driving current to the third light-emitting device, and the method further comprises:

third dropping voltages of anode electrodes of the first, second, and third light-emitting devices to voltages less than or equal to that of cathode electrodes of the first, second, and third light-emitting devices, respectively; and third storing a third threshold voltage of the third driving transistor in a state where the anode electrodes of the first, second, and third light-emitting devices are connected to each other, wherein in the first and second dropping voltages, the voltages of the anode electrodes of the first, second, and third light-emitting devices are respectively dropped to the voltages less than or equal to that of the cathode electrodes of the first, second, and third light-emitting devices.

* * * * *